US012503929B2

(12) United States Patent
Keyes et al.

(10) Patent No.: US 12,503,929 B2
(45) Date of Patent: Dec. 23, 2025

(54) ISOLATION SYSTEM WITH INTEGRATED SLIP AND EXTRUSION PREVENTION MECHANISMS AND METHODS OF USE

(71) Applicant: Defiant Engineering, LLC, Odessa, TX (US)

(72) Inventors: Cullen Craig Keyes, Hysham, MT (US); Ian Graham Janke, Parkland County (CA); Lawrence Gene Griffin, Morrison, CO (US)

(73) Assignee: DEFIANT PRECISION TECHNOLOGIES, LLC, Odessa, TX (US)

( * ) Notice: Subject to any disclaimer, the term of this patent is extended or adjusted under 35 U.S.C. 154(b) by 87 days.

(21) Appl. No.: 18/506,390

(22) Filed: Nov. 10, 2023

(65) Prior Publication Data

US 2024/0159123 A1 May 16, 2024

Related U.S. Application Data

(60) Provisional application No. 63/383,801, filed on Nov. 15, 2022.

(51) Int. Cl.
*E21B 33/128* (2006.01)

(52) U.S. Cl.
CPC ..... *E21B 33/128* (2013.01)

(58) Field of Classification Search
CPC ..... E21B 33/128
See application file for complete search history.

(56) References Cited

U.S. PATENT DOCUMENTS

| | | | | |
|---|---|---|---|---|
| 4,488,595 | A * | 12/1984 | Akkerman | E21B 23/01 166/134 |
| 9,845,658 | B1 | 12/2017 | Nish et al. | |
| 10,309,189 | B1 | 6/2019 | Branton | |
| 2004/0216868 | A1 | 11/2004 | Owen | |
| 2008/0073074 | A1* | 3/2008 | Frazier | E21B 33/1294 166/138 |
| 2010/0038072 | A1 | 2/2010 | Akselberg et al. | |
| 2019/0106962 | A1 | 4/2019 | Lee et al. | |
| 2021/0180420 | A1 | 6/2021 | Deng et al. | |
| 2021/0293112 | A1 | 9/2021 | Smith | |
| 2022/0018208 | A1 | 1/2022 | Craker et al. | |

OTHER PUBLICATIONS

International Search Report and Written Opinion received for PCT Patent Application No. PCT/US2023/079567, mailed on Apr. 3, 2024, 14 pages.

* cited by examiner

*Primary Examiner* — Catherine Loikith
(74) *Attorney, Agent, or Firm* — Workman Nydegger

(57) ABSTRACT

An example apparatus includes a rod, an uphole coupling through which the rod extends. An expansion ring is positioned on the rod below the uphole coupling, and an elastomer element is positioned on the rod below the expansion ring. A receptacle is positioned on the rod below the elastomer element and is configured to receive a portion of the elastomer element. A guardian ring is positioned on the rod below the receptacle, and a portion of the receptacle is received in the guardian ring. A cap is positioned on the rod and arranged for contact with the guardian ring, and a barrel to which the cap is connected. The rod is partially received in the barrel, and one of the barrel and the rod is movable with respect to the other of the barrel and the rod to exert a compression load on the elastomer element.

20 Claims, 12 Drawing Sheets

ISOLATION SYSTEM WITH INTEGRATED SLIP AND EXTRUSION PREVENTION MECHANISMS AND METHODS OF USE

FIELD OF THE INVENTION

One or more embodiments of the invention are generally directed to downhole systems and equipment such as may be employed in oil and gas exploration, and production. One particular example embodiment comprises a multi-set fracturing plug that can be set and re-set multiple times as part of a single downhole operation.

BACKGROUND

Downhole processes such as are employed in mining and exploration operations often involve the use of frac plugs, or simply 'plugs,' that may be configured to hold load and pressure from one side of the plug. Because the plugs are consumable items, a single downhole operation or evolution may involve the setting of multiple plugs at various locations in a wellbore. When the operation is complete, further time and effort, and corresponding expense, are required to remove the plugs, such as by drilling out the plugs. This time, effort, and expense, can be significant, as a plug is typically required at each stage of a wellbore, and some wellbores may have between 10 and 80 stages.

ASPECTS OF SOME EXAMPLE EMBODIMENTS

One example embodiment is directed to an apparatus that comprises a rod, an uphole coupling that interfaces with the rod, an elastomer element that interfaces with the uphole coupling, a receptacle configured to receive a portion of the elastomer element, a guardian ring disposed about a portion of the receptacle, a cap arranged for contact with the guardian ring, a barrel to which the cap is connected, and a downhole coupling connected to the barrel. The guardian ring comprises a split ring that prevents extrusion of the elastomer element when the apparatus is positioned in a downhole location.

As will be apparent from this disclosure, example embodiments of the invention may be advantageous in various respects. For example, an embodiment may avoid the need to use consumable frac plugs. An embodiment may avoid some or all of the time and expense associated with the use of consumable frac plugs. An embodiment may eliminate the need to drill out frac plugs. An embodiment may be reusable at multiple stages of a wellbore. Various other advantages of some example embodiments of the invention will be apparent from this disclosure.

It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

BRIEF DESCRIPTION OF THE DRAWINGS

The appended drawings contain figures of various example embodiments to further illustrate and clarify the above and other aspects of example embodiments of the invention. It will be appreciated that these drawings depict only example embodiments of the invention and are not intended to limit its scope. Example embodiments of the invention will be described and explained with additional specificity and detail through the use of the accompanying drawings.

DETAILED DESCRIPTION OF SOME EXAMPLE EMBODIMENTS

Figure 1:
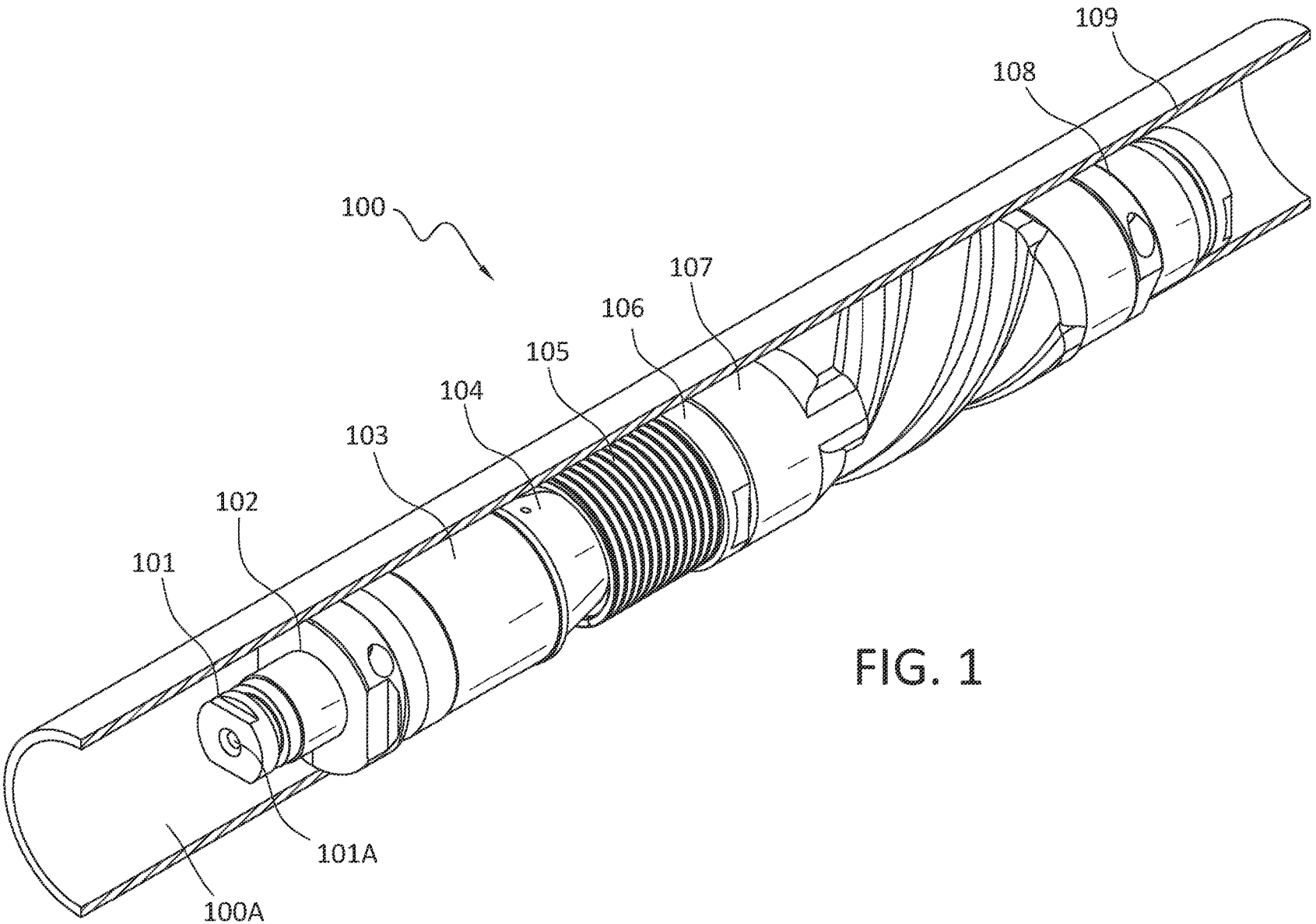
FIG. 1 is an isometric view of a plug in cased pipe.

Details are now provided concerning aspects of some example embodiments of the invention, and associated operating environments. Such embodiments may be employed in connection with downhole exploration and mining processes including, but not limited to, gas and oil exploration and mining. The scope of the invention is not limited to any particular application or use case however.

A. Context for an Example Embodiment

A.1 Frac Plugs

A composite frac plug may comprise a mandrel, upper slip, element, and lower slip. The mandrel may be the center core of the plug or provide the core structure of the plug that the other components are implemented over top of. The mandrel may have machined profiles and may comprise other constraining devices to assist the plug during pump down, setting, and the hydraulic fracture stimulation (frac or stimulation). The upper and lower slips may be configured to slide over top of the mandrel during the setting process and interact with the inside diameter of the wellbore casing. The slips may be configured and made up of hardened edges with a variety of materials such as, but not limited to, ceramic or hardened alloys. When the slips engage, or interact with the casing, they "dig or bite" into the casing wall and lock the plug in place. The slips may comprise segments that may be held together with a ring that may break or expand when the plug is set.

Between the slips, there may be an elastomer element that is compressed between the slips when the plug is set. The elastomer element may expand to contact and interact with the inside diameter of the casing, in turn creating a seal and isolating the wellbore.

A frac plug may be configured such that it is only to hold load and pressure from one side of the plug. The lower slip, located on the downhole side of the plug, may be configured to be the load bearing slip. The upper slip, located on the uphole side of the plug, may be configured to keep the elastomer element compressed maintaining a seal. The lower slip may be configured such that it does not preset during pump down or set prematurely in the well before reaching its predetermined destination. It may also be important that the lower slips be configured such that they may handle all the load that is created when the frac is occurring. The upper slips may be configured such that when the plug is set, the upper slips hold the compressed elastomer element in place and not allow it to relax or decompress.

A ball drop plug may be configured such that the center of the mandrel may act as a bypass, or flow through. Once the plug is set in the wellbore, a ball may be dropped that may seat itself into the center of the mandrel, in turn creating a flow restriction and secondary seal barrier. Now that the ball is dropped, and is interacting with the mandrel of the plug, the plug may now create an entire seal in the wellbore, completely sealing off the portion(s) of the wellbore above and/or below the plug.

A.2 Bottom Hole Assembly (BHA)

A BHA, when running a frac plug during a stimulation operation, may comprise a wireline cablehead, release tool, perforating guns, a setting tool, and a frac plug. This BHA may be conveyed by wireline. The system may be run in the wellbore by gravity and pump down. Pump down may comprise of pumping water against the tool at high flow rates to push the tool to a predetermined destination in a wellbore.

The plug may be configured such that it does not preset during pump down operations. A preset plug means that the plug, during pump down, did not have the required anti-setting forces to ensure that the tortuous travel during pump down did not set the plug prematurely in the wellbore before it reached its predetermined location. The lower slips may come into contact with the casing wall during pump down and cause the mandrel to shift and compress the elastomer element into the casing, in turn setting the upper slips as well which permanently sets the plug.

A.3 Setting the Plug

The setting tool, which may be a propellant driven device, in other words a device that may comprise an explosive charge that may be ignited in order to cause gas expansion in a barrel, which in turn compresses a piston and hydraulic fluid and shifts a rod that may be connected to the plug or connected to the mandrel of the plug. Once the plugs slips are engaged into the casing, the rod may then shear off of the plug, in turn leaving the plug in place. The setting tool may require a redress of O-rings and seals after it is pulled from the wellbore. The setting tool may also require a bleed off of expanded gas pressure, or pressure created in a chamber that may be comprised of fluids. This may be done after each run, or pump down when a plug is set in the wellbore with a setting tool.

A frac plug may be configured such that its compression does not require extra stroke length. Stroke lengths may be set by the setting tool. For example, if a plug is configured with a setting stroke length greater than 5.875," or in some cases, 8.625," a setting tool may not be able to shear off of the plug once the plug is set.

A.4 Perforating and Stimulating

When the plug is set and sealed to the inside diameter of the wellbore and the setting tool is sheared from the plug, wireline may then begin pulling out of the wellbore. While wireline is pulling out of the wellbore, it may begin firing the perf gun over a staged interval that may be up to 200 feet above the plug. Over the 200-foot section uphole of the plug, the perf gun may fire multiple shaped charges that in turn create small holes, or perforations, inside the wellbore, giving the wellbore access to the formation around it, that is, creating fluid pathways between the interior of the wellbore and the formation. Once the perf gun is completely fired, wireline may then finish pulling the BHA completely out of the wellbore.

Now that the wireline has pulled out of the wellbore, a ball may be dropped into the well that may be pumped down to the plug. The ball may then meet with the plug and seal off the center flow through of the mandrel and in turn create a complete seal. Now that this has been completed and the ball is set, pumps at the surface can now begin pumping large volumes of proppant laden fluid down the well and against the plug. The plug, being a sealing and isolating member, prevents fluid flow past the plug to the previous stage, so that the fluid is then forced to flow into the perforations that were created by the perforating gun. The fluid flow, and pressure, exceeds the formation parting pressure, causing the formation to fracture.

During this operation, one configuration of a frac plug elastomer element may extrude past the lower slips. This happens due to the increased load that is applied to the elastomer element during the frac, because of an increase in pressure downhole and against the upper slips. The upper slips and the mandrel may continue to compress the elastomer element further during the frac, in turn causing the elastomer element to extrude past the lower slips. The elastomer element extrudes and is typically destroyed or deformed to the point that it is impossible to use again. One reason that the upper slips and mandrel may continue to shift, or compress the elastomer element further, is due to the differential pressure. The downhole wellbore pressure applied to the backside of the lower slips is significantly less than the frac pressure applied to the upper slips during the frac, which in turn creates a differential pressure across the plug.

The lower slips may be configured to meet the force requirements that may be mechanically applied to the plug during the frac. This may be important for the plug to survive, or work. When the plug fails, the frac stage is a failure or the stage is not effectively stimulated. An example possible failure mode of the frac plug is that the slips do not hold or that the elastomer element over extrudes and is no longer creating a seal. When the slips do not hold, and the plug slides along the inside diameter of the casing, it may create deformation to the inside diameter of the pipe that may create further issues during the life cycle of the well. The plug can also fail if the elastomer element over extrudes and no longer creates a seal allowing fluid to flow past the plug, this may also cause erosion and damage the casing. Plugs may be configured to have a backup system that may be an elastomer that expands with the elastomer element during the frac. The backup system that may expand with the elastomer element is typically a polymer that undergoes plastic deformation during the frac. This means that the backup system is destroyed or does not return to its original state or form after the frac is completed. The frac plug is configured as a consumable product that is typically only to be used once.

A.5 Plug Drill Out

Once the entire wellbore is stimulated, it is then time to perform the final operation, which is drilling out the plugs. This may be done with a coiled tubing or workover unit using stick-pipe equipment and a downhole motor and mill assembly. As noted herein, drill-out may be an expensive and time-consuming process, particularly in wellbores with numerous stages.

The unit may be spotted in after the frac equipment is moved off the wellsite. The unit may rig up to the wellhead and begin running stick-pipe, or continuous coil and a motor and mill into the wellbore. Stick-pipe may be rotated with a swivel, or top drive mechanism that rotates the pipe in the wellbore. The continuous coil may have a motor that is hydraulically activated by pumping fluid through the pipe, in turn turning the mill located downhole of the motor.

Each plug that was set between every stage in the wellbore during the frac, may need to be drilled out. The number of plugs may vary, some wellbores may have anywhere between 10 and 80 stages, but not limited to. This would mean that there would be a plug for every stage, all of which would need to be drilled out. This is an expensive and time-consuming process.

B. Discussion of General Aspects of an Example Embodiment

B.1 Multi-Set Frac Plug

An example embodiment may comprise a multi-set frac plug, that is, a plug that can be used repeatedly, that may comprise one or more receptacles, one or more guardian rings, an elastomer element, a rod, and a hydraulic barrel. The multi-set frac plug, may be referred to hereafter as "the plug."

One example embodiment may be configured, and assembled, as follows: [1] insert rod into barrel; [2] slide cap over rod and lock into barrel; [3] slide guardian ring over the rod; [4] slide receptacle over the rod and pin the receptacle to the rod; and [5] slide the elastomer element over the rod.

In operation, of one embodiment, the barrel may be hydraulically activated and the piston on the rod begins to actuate and starts to compress the system. As the system goes into compression, the elastomer element is compressed into the receptacle and the receptacle is compressed into the guardian ring. The receptacle guide pin will reach the end of its travel length and stop the receptacle from moving. This will allow the guardian ring to travel up the receptacle and the elastomer element to compress even more. The guardian ring will contact the end of its travel on the receptacle and continue to expand outward towards the casing wall. The elastomer element will also continue to compress out to the inside diameter of the casing wall until the casing is sealed. The guardian ring and the receptacle will interact with the elastomer element and keep the elastomer element from extruding while under load.

In more detail, the plug may have a rod that runs through the center of the assembly and is the core structure of the plug. The rod may have a through way machined, drilled, or manufactured in place through its center. Around the rod, there may be an uphole guardian ring, an uphole receptacle, an elastomer element, a downhole receptacle, and a downhole guardian ring.

When setting the plug, the guardian rings may be configured to slide up the sloped areas of the receptacles and expand in order to thereby interact or engage with the inside diameter wall of the casing, or until the guardian ring(s) meets the landing located at the end of each receptacle. The guardian rings may be made from, but not limited to, an alloy with significant restoring forces. Such alloys may include, but are not limited to, 41XX 43XX series alloys, Modifieds and vanadium high carbon steels, nickel alloys, copper alloys, and composites.

When the guardian rings interact with the casing, they may not "dig into" or "bite" the inside wall of the casing. In an embodiment, the guardian rings are primarily configured to ensure that, when the elastomer element is under compression and load, the elastomer element has no area to extrude past. The guardian ring may be a multi-layer ring, or spring like design where the rings expand as they travel up the receptacle. The guardian rings may also create a seal barrier, or metal to metal type seal, when in the expanded state. In an embodiment, the elastomer element may be removed completely from the plug, so that the plug may seal the wellbore using only the guardian rings.

The receptacles may comprise mechanisms, made of various alloys, that may be fixed to the rod. Although fixed to the rod, the receptacles may slide back and forth on the rod in a receptacle guide. The travel length, or stroke of the receptacle may be configured such that the receptacle comes to a fixed stopping point at the end of each receptacle guide. Once the receptacle reaches the stopping point, it may then begin compressing the elastomer element and begin allowing the guardian rings to start sliding up the receptacles until the elastomer element is completely compressed and the guardian rings are engaged with the elastomer element and are acting as the extrusion prevention barrier of the elastomer element.

In an embodiment, the plug may not require a ball to be dropped once set. The plug may be configured such that the stimulation process may take place while tethered to wireline and continuously pumping while keeping the wireline in the wellbore before, during, and after the frac.

B.2 Bottom Hole Assembly (BHA)

The BHA, when running a plug, may comprise, in the order of uphole to downhole configuration, a cablehead connection, a sensor sub that may comprise, pressure sensor, temperature sensors, orientation sensors, and accelerometers, the plug, a hydraulic reservoir, hydraulic slips, a controls sub that may comprise a CPU (central processing unit) or master controller, and a perforating gun or dispenser. The plug may be run in the wellbore by gravity and/or pump down. Pump down may comprise pumping water and/or other fluids against the tool at high flow rates to push the tool to a predetermined destination, or destinations, in the wellbore.

An embodiment of the plug may be configured so that there is no section of the plug that can cause the plug to preset and engage the casing and cause the plug to set prematurely during pump down. The guardian rings may be configured such that they are recessed enough that they may not, until the desired downhole location for the plug is reached, come into contact with the casing wall, slide up the receptacle, and expand.

B.3 Perforating

In an embodiment, the plug may not be set before perforating the wellbore. Instead, the perforating may begin before the plug is set. The perforating system within the BHA may comprise a dispenser that may carry penetrators that are configured to perforate the wellbore casing. The dispenser may discharge, or dispense one, or more, penetrators at one time and create perforations in the wellbore. Once those perforations have been made, the BHA may be pumped past the created perforations. Once the plug has passed the perforations, it is then time to set the plug.

B.4 Setting a Plug

In an embodiment, a setting tool may note be required to set the plug. An embodiment of the plug may configured to be multi-set, that is, set in multiple different downhole locations, and be tethered to wireline. The plug may be set by communication from the surface being sent down the wireline and to the CPU located in the tool. The CPU may receive the command to activate the hydraulic power unit and set the slips located below the plug. An additional signal may be sent to the secondary hydraulic power unit to begin pressuring up the compression end of the piston that is located in the barrel. The rod may then begin to shift and pull back into the barrel. Once the receptacle guide pin reaches its full stroke along the receptacle guide located on the rod, the receptacles may begin compressing the elastomer element and the guardian rings may begin to travel up the receptacles and expand to mate with, or otherwise interact with, the casing wall.

Stroke length may be a design feature required for the plug to work efficiently. Because of the frac pressure applied to the elastomer element during the frac, the elastomer element may continue to compress against the receptacle and guardian ring and continue to create a stronger seal. The piston located in the barrel may be configured to bottom out during the frac. The plug stays intact to the BHA and there is no shearing that takes place where the plug is left behind in the wellbore.

B.5 Hydraulic Fracture Stimulation

Now that the plug is set and the slips are anchoring the BHA in the wellbore, frac fluid may be pumped at, but not limited to, low rates—for example, 5-50 BPM (barrels/minute)—down the wellbore without pulling wireline out of the hole. The proppant laden fluid may be pumped down the well and against the plug. The plug, being a sealing and isolating member, may prevent some, or all, fluid flow past the plug to the previous stage, with the result that the fluid is then forced to flow into the perforations that were created by the perforating gun. The fluid flow, and pressure, exceeds the formation parting pressure, causing the formation to fracture.

During an example stimulation operation, the guardian rings of the plug are now protecting and preventing the elastomer element from over extruding and deforming or destroying itself while under frac pressure and high loads created during the frac. The piston, bottoming out in the barrel, also prevents further stroke or shifting in the plug that may cause the elastomer element to continue to extrude. Since the guardian rings may not have teeth, or dies, manufactured into the rings, the plug may not damage or deform the casing.

Once the stage of the wellbore is stimulated, a signal may be sent down the wireline to the CPU to unseal. The unsealing process is done by the hydraulic power unit pressuring up the decompression chamber of the barrel and stroking the rod out. The receptacles then pull away from the elastomer element and allow the elastomer element to relax, in turn the guardian rings then go from an expanded state back to their normal state and slide back down the sloped area of the receptacle. The slips below the plug may then be unset, and the plug may then be pulled up hole past the already stimulated stage. Once the plug reaches the next area to perforate and stimulate, the process of perforating and pumping the plug past the perforations, sealing, stimulating, and unsealing and pulling uphole to the next stage may be repeated until the wellbore is completely stimulated. In an embodiment, the plug is not a consumable item and no setting tool may be required to set it.

B.6 Plug Drill Out

Since, in some embodiments at least, no plugs are left in the wellbore after the frac, there may be no need to perform a drill out operation that might otherwise be required when using a consumable plug.

C. Detailed Discussion of Aspects of an Example Embodiment

C.1 FIG. 1

With reference first to FIG. 1, there is disclosed an embodiment 100 of a multi-set frac plug inside of cased hole 100A, or a pipe. The plug 100 may be tethered, conveyed on pipe or coiled tubing, or conveyed by downhole propulsion systems or tractors.

C.1.1 Rod

The plug 100 may include a rod 101 that may be made of various materials including, but not limited to, an alloy material and manufactured to enable A) the ability to assemble an uphole coupling, expansion ring, elastomer element, receptacle, and guardian ring to be assembled around the outside of the rod 101 and B) a conduit 101*a* may be drilled, machined, or additively manufactured in place and through the center of the rod 101 such that components such as cables, electronics, or other devices may be implemented or passed through the center 101*a* of the rod 101.

In terms of its manufacturing, an embodiment of the rod 101 may be produced by processes such as casting, machining from solid material, or 3D printed or manufactured through a process such as additive manufacturing. The material(s) used to manufacture the rod 101 include, but are not limited to, alloys such as aluminum, manganese, zinc, or other bronze alloys, steel, or steel with combinations of carbon, silicon, manganese, aluminum, molybdenum, nickel, and or vanadium. The steel alloy may comprise a stainless steel, or stainless steel with combinations of nickel, copper, or manganese. The rod 101 may comprise aluminum alloys, or combinations of zinc, copper, or iron. The rod 101 may be made from alloys such as nickel, or nickel alloys and or combinations of nickel with materials such as iron, chromium, copper, and or molybdenum. Other materials from which the rod may be manufactured may also include, but not limited to, iron, titanium, polymers or plastic, carbon fiber, and or tin.

C.1.2 Uphole Coupling

The plug 100 may comprise an uphole coupling 102 which may be used to link, connect, or couple other tools, modules, or devices such as, but not limited to, wireline cable heads, weight bars, orientation tools, casing collar locators, sensor subs that may house sensors such as, but not limited to, temperature, pressure, and accelerometers. The uphole coupling 102 may comprise two mechanical pieces with a threaded outer diameter that is linked together and connected to the rod 101.

C.1.3 Elastomer Element

The elastomer element 103, or simply "element," may be used as an isolation or sealing device. The elastomer element 103 may be sculpted with multiple layers of polymer, and cured, or treated, in an autoclave. The elastomer element 103 may be compression molded, or injection molded. The elastomer element 103 may be manufactured, or made, with materials such as, or combinations of, AFLAS (materials sold under this mark include a fluoroelastomer based on an alternating copolymer of TFE (tetrafluoroethylene) and propylene, VITON (materials sold under this mark include fluoroelastomers), or HNBR (hydrogenated nitrile rubber).

In an embodiment, the durometer property of the elastomer element 103 may range from, but not limited to, 20 durometer to 100 durometer.

C.1.4 Receptacle

The receptacle 104 may be used to conceal, such as by receiving, sections of the elastomer element 103 while the elastomer element 103 is in its relaxed or uncompressed state, and when the elastomer element 103 is engaged or in a compressed state.

In terms of its manufacturing, the receptacle 104 may be cast, machined from solid material, or 3D printed or manufactured through a process such as additive manufacturing. Example materials for the receptacle 104 may include alloys such as aluminum, manganese, zinc, or other bronze alloys, as well as steel, or steel with combinations of carbon, silicon, manganese, aluminum, molybdenum, nickel, and or vanadium. The steel alloy may comprise a stainless steel, or stainless steel with combinations of nickel, copper, or manganese. As well, the receptacle 104 may be made of aluminum alloys, or combinations of zinc, copper, or iron. The receptacle 104 may be made from alloys such as, but not limited to, nickel, or nickel alloys and or combinations of nickel with materials such as iron, chromium, copper, and or molybdenum. Other materials for the receptacle may also include, but not limited to, iron, titanium, polymers or plastic, carbon fiber, and or tin.

C.1.5 Guardian Ring (GR)

A guardian ring (GR) 105 may comprise a spiral split ring design which, when under compression, may expand its outside diameter to conform to the inside diameter of a pipe, casing, or wellbore. The GR 105, when under decompression, may retract, or relax, and transition back into its natural, or undeformed, state. The GR 105 may be used to conceal, or protect the outer diameter of the elastomer element 103 while the elastomer element 103 is in its compressed state.

In an embodiment, the GR 105 may be made by casting, machining from solid material, or 3D printed or manufactured through a process such as additive manufacturing. The material(s) used to manufacture the GR 105 may vary, and may include, alloys such as aluminum, manganese, zinc, or other bronze alloys, steel, or steel with combinations of materials such as carbon, silicon, manganese, aluminum, molybdenum, nickel, and or vanadium. The steel alloy may comprise a stainless steel, or stainless steel with combinations of nickel, copper, or manganese. Other materials include aluminum alloys, or combinations of, zinc, copper, or iron. The GR 105 may be made from alloys such as, but not limited to, nickel, or nickel alloys and or combinations of nickel with materials such as iron, chromium, copper, and or molybdenum.

Still other materials for an example GR 105 include, but not limited to, iron, titanium, polymers or plastic, carbon fiber, and or tin. The GR 105 may also be manufactured from materials such as, but not limited to, chromium vanadium ASTM A231, silicon manganese, chromium silicon ASTM A401, stainless type 302 ASTM A313, stainless type 304 ASTM A313, stainless type 316 ASTM 313, stainless type 17-7 PH ASTM A313, stainless type 414 SAE 51414, stainless type 420 SAE 51420, stainless type 431 SAE 51431, spring brass ASTM B 134, phosphor bronze ASTM B 159, beryllium copper ASTM B 197, and any of the respective materials sold under the following marks: MONEL (materials sold under this mark include group of alloys of nickel, from 52 to 67%, and copper, with small amounts of iron, manganese, carbon, and silicon), "K" Monel (materials sold under this mark include the MONEL alloys to which aluminum and titanium have been added to the nickel-copper base), Inconel "X" (materials sold under this mark include a family of austenitic nickel-chromium-based superalloys, specifically, nickel-chromium alloys, blended with aluminum and titanium), DURANICKEL (age-hardened nickel alloy), ELINVAR (nickel-chromium alloy), NI-SPAN (nickel-chromium alloy), ISO-ELASTIC (iron-nickel alloy), ELGILOY (cobalt-chromium-nickel super alloy), and/or DYNAVAR (corrosion resistant, non-magnetic, age-hardening type cobalt-base alloy). Where a coating or other treatment is employed on a component, such as the GR 105 for example, these may include, but are not limited to, organic zinc flake coating, electroplating, electropolishing, powder coating, pre-plated wire, tumbling, shot peening, and electroless plating.

C.1.6 Cap

The cap 106 may comprise an alloy material that may be threaded, or pressed into the hydraulic cylinder/barrel to provide a barrier inside of the hydraulic cylinder to pressure up fluids against when the plug 100 is in compression or decompression. The cap 106 may also contain polymer, or alloy seals that inhibit fluids, or contaminants, from entering or exiting the cylinder/barrel 107, discussed below.

C.1.7 Barrel

Figure 2:
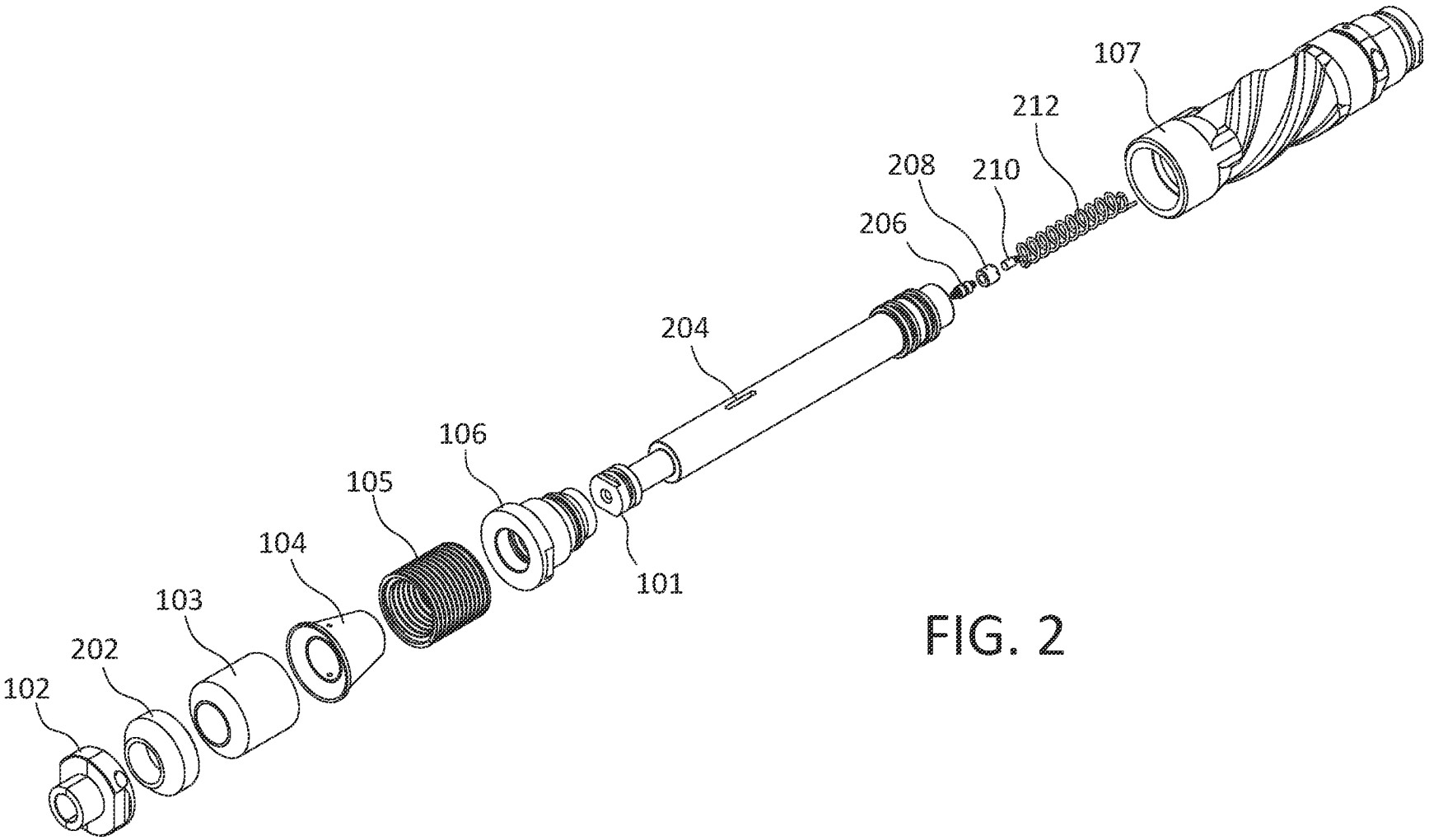
FIG. 2 is an assembly view of the plug and some components.

In an embodiment, a barrel 107 of a plug 100 may comprise a cylinder that contains hydraulic fluid and an actuating piston. The barrel 107 may act as a pressure chamber that may, but not limited to, hydraulically pressure up one side, or the other side, of a piston and, in turn, stroke a rod in and out of the barrel 107 through the cap 106. As shown in FIG. 2, for example, a barrel 107 may comprise a twist configuration. The twist geometries on the outside of the barrel 107 may have the hydraulic conduits printed inside of them, and the twists may also add external strength to the body of the barrel 107. The use of twists in this way may allow the plug 100 to work under higher pressures internally and externally.

The barrel 107 may be made by casting, machining from solid material, or 3D printed or manufactured through a process such as additive manufacturing. When 3D printing, or manufacturing the barrel 107 by additive manufacturing, the barrel 107 may have the hydraulic conduits, or piping, fittings, and pump interfaces printed into the barrel 107.

The material(s) used to manufacture the barrel may comprise alloys such as aluminum, manganese, zinc, or other bronze alloys, or steel, or steel with combinations of, but not limited to, carbon, silicon, manganese, aluminum, molybdenum, nickel, and or vanadium. The steel alloy may be a stainless steel, or stainless steel with combinations of nickel, copper, or manganese, or aluminum alloys, or combinations of zinc, copper, or iron. The barrel 107 may be made from alloys such as nickel, or nickel alloys and or combinations of nickel with materials such as iron, chromium, copper, and or molybdenum. Other materials may also include, but are not limited to, iron, titanium, polymers or plastic, carbon fiber, and or tin.

C.1.8 Downhole Coupling

The downhole coupling 108 may be configured to be used to link, connect, or couple, to the plug 100, various other tools, modules, or devices such as, but not limited to wireline cable heads, weight bars, orientation tools, casing collar locators, sensor subs that may house sensors such as, but not limited to, temperature, pressure, and accelerometers. In an embodiment, the downhole coupling 108 may be made up of two mechanical pieces with a threaded outer diameter that is linked together.

C.1.9 Pipe

The pipe 109 in which an embodiment of the plug 100 may be deployed may comprise, for example, transmission pipelines for fluids, wellbore casing, or downhole tubing.

C.2—FIG. 2

FIG. 2 shows an exploded view that lays out the components that make up the assembly of an example embodiment of a plug, such as the plug 100 of FIG. 1.

C.2.1 Uphole Coupling

Further details are provided now concerning the uphole coupling 102, also disclosed in FIG. 1. The uphole coupling 102 may be assembled to the rod 101 in order to make a rigid connection. The uphole coupling 102 may comprise two halves that may be bolted, keyed and pinned, or threaded together to make one solid uphole coupling 102. The uphole coupling 102 may couple together and reside in a seat that may be located on the surface of the rod 101. The uphole coupling 102 may be the fixture connected to the rod 101 that compresses the elastomer element 103 and/or an expansion ring, one example of which is discussed below.

C.2.2 Expansion Ring

The expansion ring 202 may comprise an HNBR, VITON, or AFLAS elastomer with durometers greater than 90. The expansion ring 202 may be slid over top of the rod 101 and reside between the uphole coupling 102 and the elastomer element 103, as shown in FIG. 2. When the expansion ring 202 is compressed, it may expand with the elastomer element 103 and conceal sections of the elastomer element 103. The expansion ring 202 may act as a spring, such that when the plug 100 decompresses, the expansion ring 202 springs back to its uncompressed, or relaxed, state.

C.2.3 Elastomer Element

The elastomer element 103 may be slid over top of the rod 101 and reside between the expansion ring 202 and the receptacle 104. The elastomer element 103 outside diameter (OD) and length may change based on the inside diameter of the pipe 109, casing, or wellbore that the plug 100 is being used in.

C.2.4 Receptacle

The receptacle 104 may be slid over top of the rod 101 and be pinned to the receptacle guide that may be fixed to the rod 101.

C.2.5 Guardian Ring

The GR 105 may be slid over top of the rod 101 with one or more sections, or portions, of the GR 105 residing on the receptacle 104, and one or more sections, or portions, of the GR 105 residing also on the rod 101.

C.2.6 Cap

The cap 106 may be slid over top of the rod 101 and be threaded, or pressed, into the barrel 107.

C.2.7 Rod

The rod 101 may comprise a seating surface on/around which the uphole coupling 102 may reside. The rod 101 may further comprise a machined feature 204, such as a slot for example, which may be referred to herein as a "receptacle guide," that may control the stroke length, or travel, of the receptacle 104, and a piston that may allow fluids to pressure up against and stroke the rod 101 in and out of the barrel 107. In an embodiment, the receptacle guide 204 receives, or otherwise engages, a portion of the rod 101, and a length of the receptacle guide 204 thus limits the extent to which the rod 101 is able to move back and forth.

C.2.8 Receptacle Guide

In more detail, the receptacle guide 204 may be fixed on, machined into, or otherwise connected to or made a part of, the outer surface of the rod 101 so as to control the travel and stroke of the receptacle 104. The receptacle guide 204 may comprise, for example, an opening that is shaped as a square, rectangle, ellipse, or oval.

C.2.9 Pressure Connector

A pressure connector 206 may comprise a low or high frequency connector that may allow for another connector to connect to it so that electrical signals, commands, and communication from the surface to the tool, or tool to the surface, to travel. The pressure connector 206 may be configured to withstand atmospheric pressure on one side and high pressure, or wellbore pressure, on the other side of the pressure connector 206 to be established and maintained, while still maintaining a solid fixed connection as well as act as a seal of a wellbore.

C.2.10 Retaining Nut

A retaining nut 208 may be provided that may act as an additional retainer for the pressure connector 206.

C.2.11 Harness

A harness 210 may be provided that may comprise a single wire, or bundle of wires that may be connected to an electrical connector that may connect to the pressure connector 206. The harness 210 may also be referred to as a 'wiring harness.'

C.2.12 Cable

A cable 212 may be provided that may comprise one or more wires or other electrical conductors that that may operate to convey power signals and communication throughout throughout a tool to which the plug 100 may be connected.

C.2.13 Barrel

The barrel 107 may comprise a hydraulic cylinder. The rod 101, piston (see FIG. 4, discussed below), pressure connector 206, retaining nut 208, harness 210, and cable 212 may reside inside of the barrel 107.

C.3—FIG. 3

Figure 3:
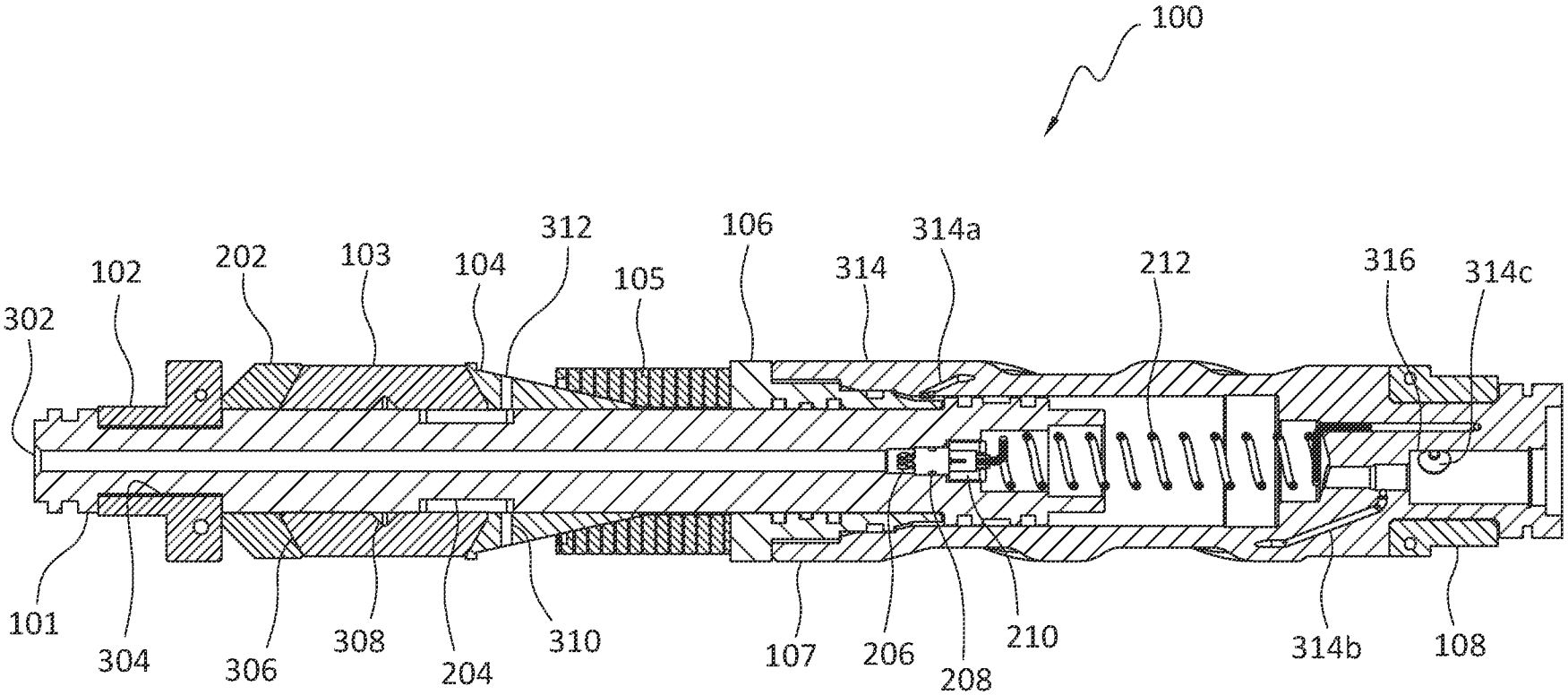
FIG. 3 is a cross section side view of the plug.

In general, FIG. 3 discloses a cross section of an example embodiment of a plug 100 in its uncompressed, or undeformed, state.

C.3.1 Electrical Conduit

An electrical conduit 302 may serve as a pathway that may be machined, gun drilled, or if the rod 101 is 3D printed, printed into the rod 101. The electrical conduit 302 comprises a pathway that may enable electrical cabling or wires to travel through the center of the rod 101.

C.3.2 Rod

The rod 101 may enable assembly of an uphole coupling 102, expansion ring 202, elastomer element 103, receptacle 104, and guardian ring 105 to be assembled around the outside of the rod 101. In an embodiment, a conduit or other passageway may be drilled, machined, or additively manufactured in place and through the center of the rod 101 to enable the passage of cables, electronics, or other devices, through the center of the rod 101.

C.3.3 Uphole Coupling

In an embodiment, the uphole coupling 102 is assembled to the rod 101 in order to form a rigid connection between the two. The uphole coupling 102 may comprise two mating halves that may releasably couple together and reside in an annular seat 304 that may be located on the surface of the rod 101. The uphole coupling 102 may be the fixture connected to the rod 101 that, in operation, compresses the expansion ring 202 and/or the elastomer element 103. The uphole coupling 102 may be used to link, connect, or couple, to the rod 101, other tools, modules, or devices such as, but not limited to wireline cable heads, weight bars, orientation tools, casing collar locators, sensor subs that may house sensors such as, but not limited to, temperature, pressure, and accelerometers.

C.3.4 Expansion Ring

The expansion ring 202 may be slid over top of the rod 101 and reside between the uphole coupling 102 and the elastomer element 103. When the expansion ring 202 is compressed, it may expand with the elastomer element 203 and conceal portions of the elastomer element 103. The expansion ring 202 may act as a spring, such that when the plug decompresses, the expansion ring springs back to its uncompressed, or relaxed, state.

The expansion ring 202 may be configured such that surface contact between the elastomer element 102 and the expansion ring(s) 202 are angled 306 to match the same degree or shape. For example, both the expansion ring 202 and the elastomer element 103 may have a 45-degree angle where they mate up. The angle 306 may be of a degree to allow the expansion ring 202 to conceal or protect the elastomer element 103 in its uncompressed and relaxed state. When the expansion ring 202 expands under compression, it may also conceal and protect portions of the elastomer element 103.

C.3.5 Elastomer Element

The elastomer element 103 may be used as an isolation or sealing device. The elastomer element 103 may also have an annular groove 308 that may be machined out of or manufactured into the center of the elastomer element 103. The annular groove 308 may enable the elastomer element 103 to expand, relative to an uncompressed state of the elastomer element 103, to a larger diameter when under compression and the annular groove 308 may also reduce the amount of stress that may go into the elastomer element 103 while it is under compression or load.

C.3.6 Receptacle

The receptacle 104 may be used to conceal and protection portions of the elastomer element 103 while the elastomer element 103 is in its relaxed or uncompressed state, and when the elastomer element 103 is engaged or in its compressed state. The receptacle 104 may define a pin hole 310 that may enable a receptacle guide pin 312, discussed below, to connect the receptacle 104 to the receptacle guide 204 that may be fixed in, or to, the rod 101.

C.3.7 Receptacle Guide Pin (RGP)

A receptacle guide pin (RGP) 312 may be made from an alloy material. The RGP 312 may be inserted into the receptacle 104 and into the receptacle guide 204 that may be located on the rod 101. The RGP 312 may act as an anti-rotation device for the receptacle 104, as a pin that moves in unison with the receptacle 104 forward and backwards through the receptacle guide 204 that is located on the rod 101, and the RGP 312 may also stop the receptacle 104 from moving by contacting each end of the receptacle guide 204.

C.3.8 Receptacle Guide (RG)

The receptacle guide 204 may comprise a machined surface, or profile, in the rod 101 that enables the receptacle guide 204 to slide back and forth on the rod 101. The receptacle guide 204 may also be configured to stop the receptacle 104 from sliding back and forth or locking the receptacle 104 in place causing the receptacle 104 to begin compressing the elastomer element 103 and forcing the GR 105 to slide up the receptacle 104.

C.3.9 Guardian Ring (GR)

The GR 105 may comprise a spring-like design, spring, or split ring that may have multiple layers of alloy rings. Under compression, the rings of the GR 105 may expand outward so that the outside diameter of the GR 105 conforms to, or is the same as, or nearly the same as, the inside diameter of the casing wall, or pipe 109. In an embodiment, the plug 100 may comprise an uphole GR 105 located on the uphole side of the elastomer element 103, and a downhole GR 105 located on the downhole side of the elastomer element 103.

Figure 10:
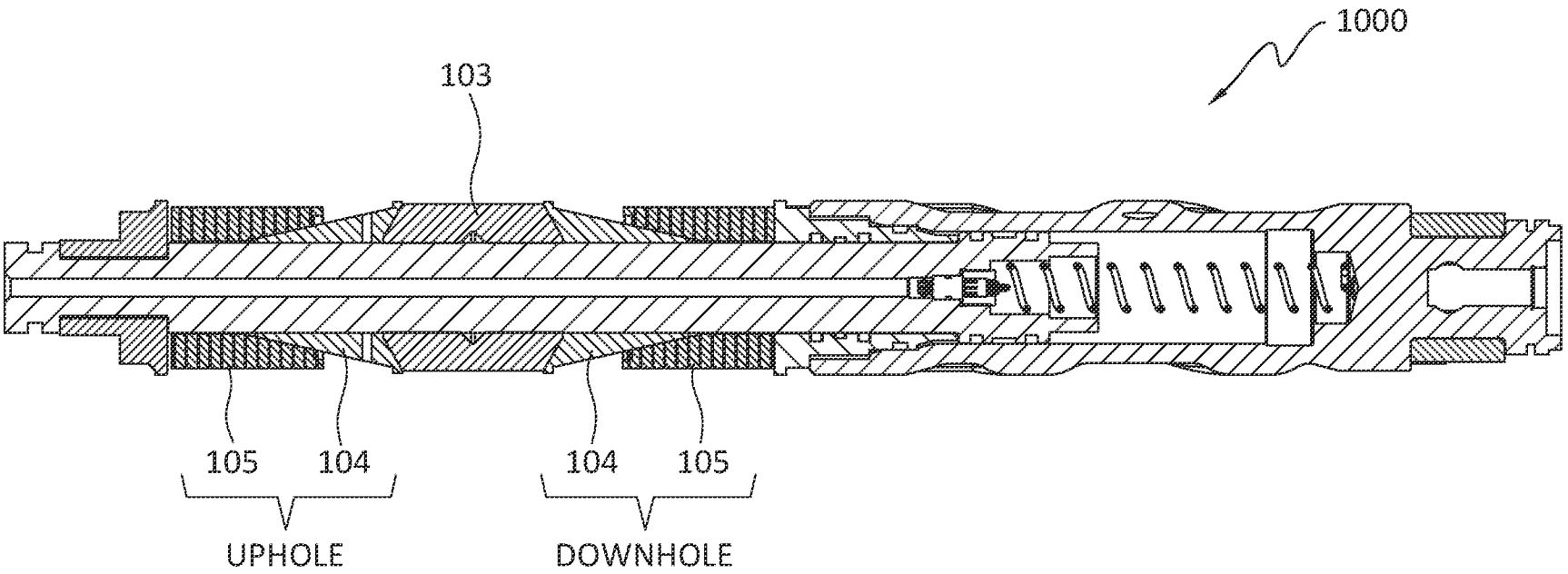
FIG. 10 is a cross section side view of a plug with two sets of guardian rings and receptacles.
Figure 11:
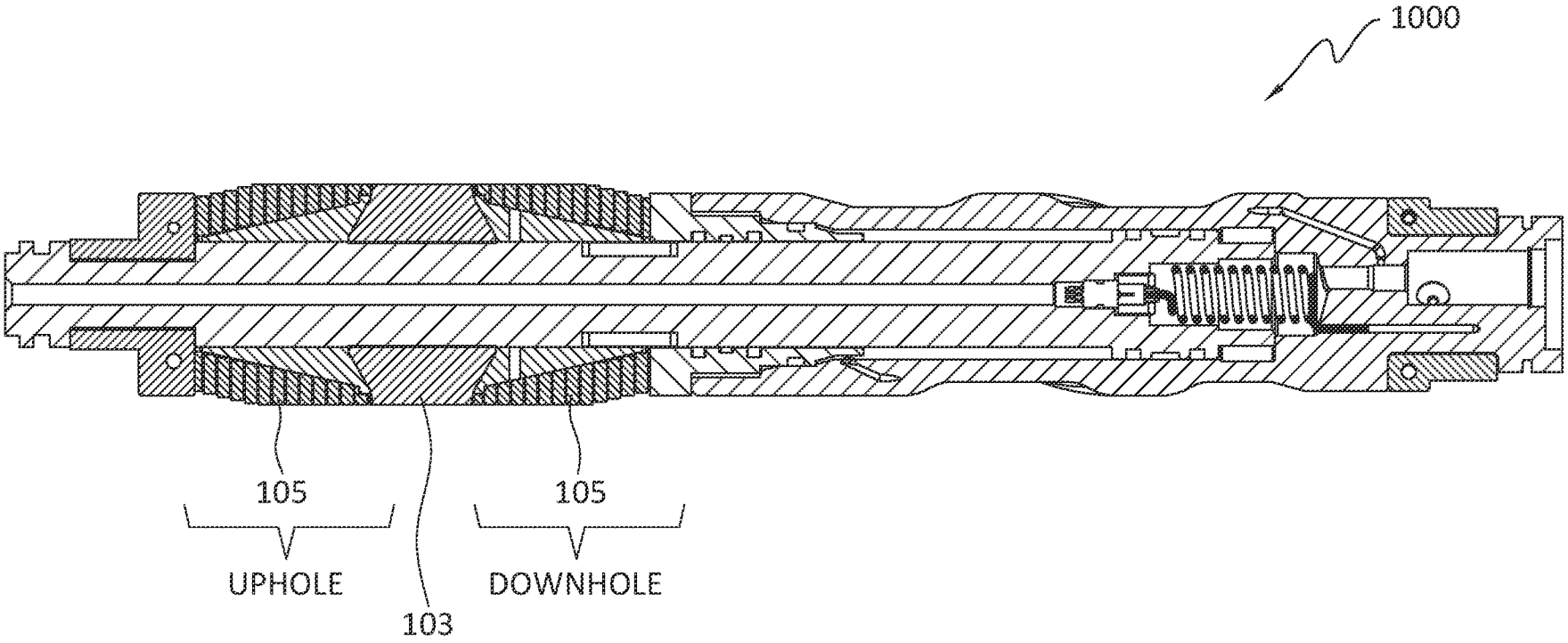
FIG. 11 is a cross section side view of a plug in a compressed state with two sets of guardian rings and receptacles.

The uphole GR, as shown in FIGS. 10 and 11, may take the place of the expansion ring. The uphole GR 105 may act as a barrier that protects the elastomer element 103 from damage caused by abrasive materials, such as frac sand that is flowing into the elastomer element 103. The uphole GR 105 may also act as an extra seal of the wellbore, pipe, or other element in which the plug 100 is located. The metal to metal contact of the rings that comprise the GR 105, and the contact between the GR 105 and the receptacle 104, may create a seal in the pipe or wellbore that does not allow for fluid to flow past the plug 100 when the plug 100 is set.

The uphole GR 105, when acting as a seal, may take the forces that are typically applied to the elastomer element 103 away. When the uphole GR 105 expands and conforms to the casing, the GR 105 is also locked in place by the receptacle 104 and cannot move, even under extra load and mechanical forces applied during a frac or other downhole process. When this takes place, the elastomer element 103 may not sustain an extra loading that is applied to an elastomer element 103 of a different configuration during the stimulation process or operation. The downhole GR 105 may act as a load bearing ring and extra seal, and this load bearing ring may, in turn, also act a set of slips, that locks the plug 100 into the pipe 109, casing, or other element. The downhole GR 105 may also act as a prevention mechanism for elastomer element 103 extrusion. In particular, since the downhole GR 105 may conform to the inside diameter (ID) or other feature of the casing wall when expanded, the elastomer element 103 then has no space in which to extrude when the frac loads are applied to the elastomer element 103 while the elastomer element 103 is in compression. This may also ensure that the elastomer element 103 is not exposed to any differential pressure when an uphole and downhole guardian ring 105 is in place and expanded.

C.3.10 Barrel

The barrel 107 disclosed in FIG. 3 may comprise a 3D printed part. 3D printing the barrel 107 out of an alloy material may eliminate the need to gun drill hydraulic pathways, machine interfaces for hydraulic fittings and hydraulic power units, or pumps, as well as machining interfaces for electrical connectors.

C.3.11 Hydraulic Conduit

A hydraulic conduit 314 may comprise a first hydraulic conduit **314*a* and a second hydraulic conduit 314*b***, each of which is discussed below.

The hydraulic conduit **314*a* may comprise a 3D printed hydraulic pathway/conduit through which hydraulic fluid, pressured up by or forced by, but not limited to, a hydraulic pump/power unit, may travel. FIG. 3 also discloses an outlet port, that is, an opening leading into the barrel from the hydraulic conduit 314*a*, that leads into the compression pressure chamber, that is, the interior, of the barrel 107. Fluid may come out of this port that pressurizes the compression chamber and forces the piston to actuate. In an embodiment, no machining, casting, or post processing is required to manufacture the hydraulic conduit 314*a***.

The hydraulic conduit **314*b* may comprise a 3D printed hydraulic pathway/conduit where hydraulic fluid, pressured up by or forced by, but not limited to, a hydraulic pump/power unit, travels though. FIG. 3 also discloses the beginning 314*c* of a 3D printed pathway that connects to the hydraulic conduit 314***a*. This is the section of the conduit that interfaces with the pump. In an embodiment, no machining, casting, or post processing is required to manufacture the hydraulic conduits 314*a* and 314*b*.

C.3.12 Pressure Connector

The pressure connector 206 may comprise a hermetically sealed electrical connector that may work under different differential pressures. The pressure connector 206 may be incorporated to ensure that the pressure generated in the barrel 107 does not transition into, or is exerted upon, the rod 101.

C.3.13 Retaining Nut

The retaining nut 208 may be used to lock the harness 210 and pressure connector 206 place, and thus ensure that there may be no chance that the connection breaks or comes loose. Note that, in an embodiment, the pressure connector 206 may comprise a hermetically sealed shielding that encapsulates an electrical connection that comprises an electrical connector. Thus, by connecting the pressure connector, an electrical connection, using the electrical connector, may also be made and may enable the electrical connector to operate under pressure.

C.3.14 Harness

The harness 210 may comprise, but is not limited to, bundle of wires with a connector that connects to the pressure connector 206. This connection between the harness 210 and the pressure connector 206 may enable communication uphole and downhole through the rod and barrel of the plug.

C.3.15 Cable

Figure 4:
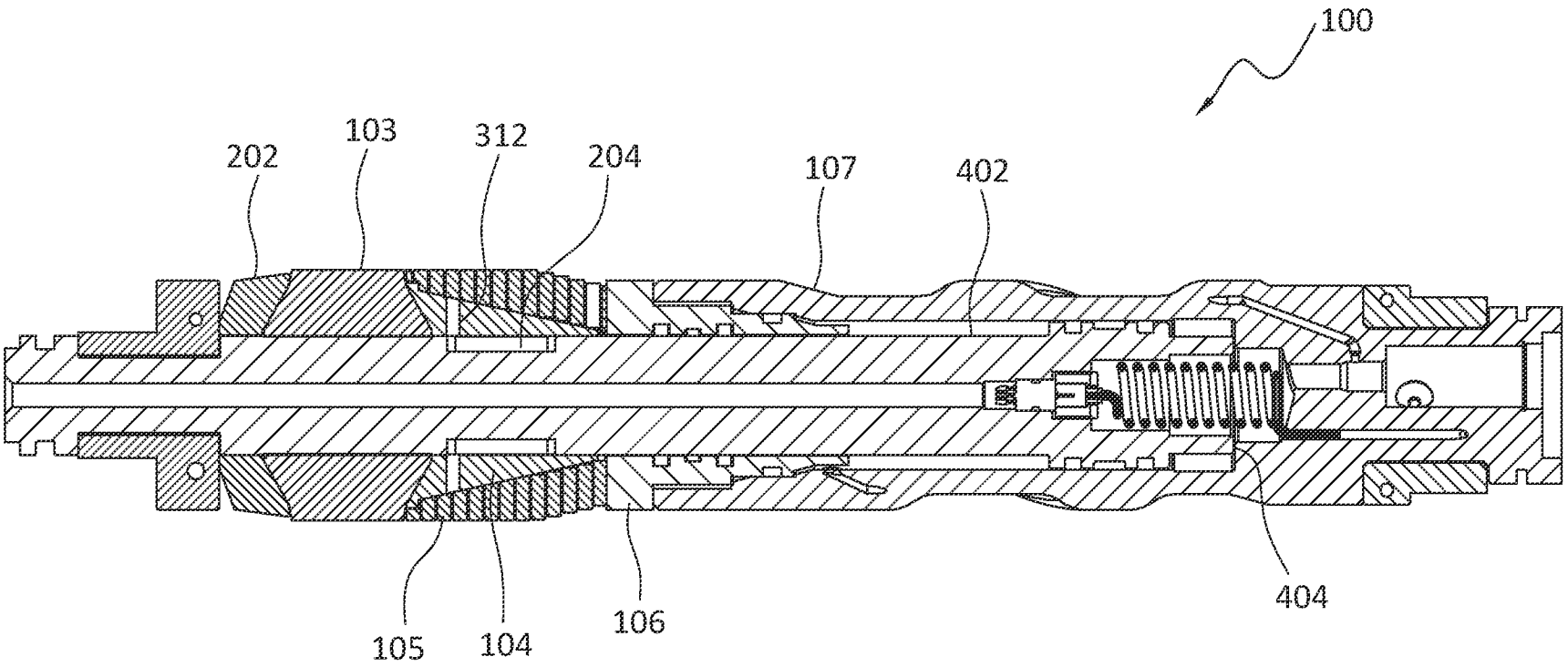
FIG. 4 is a cross section side view of a plug in a compressed state.

The cable 212 may comprise a memory alloy cable that acts as a shield, or armor, and protects the wires that are located inside of the cable 212. The cable 212 may be configured with a memory alloy shield, or armor, that has a returning spring force and ensures that the cable 212 does not get pinched or sheard by the piston (see FIG. 4) when the piston 404 bottoms out, as shown in FIG. 4.

C.3.16 Pump Interface

The pump interface 316 may comprise a 3D printed interface that houses the pump, or hydraulic power unit. Use of a 3D printed interface, as an implementation of the pump interface 316, may eliminate the need to machine, or at least reduce machine time significantly. It may also allow the ability to 3D print the hydraulic conduits required to transport hydraulic fluid throughout the plug 100. A hydraulic pump or hydraulic power unit (not shown in FIG. 3 3) may interface with the pump interface 316 and eliminate the need for fitting connections or potential weak points where hydraulic fluid may leak from the plug 100.

C.3.17 Downhole Coupling

The downhole coupling 108 may connect other tools to the plug 100, such as slips, hydraulic reservoir, accumulator, sensor sub, perforating gun, dispenser, or a master controller sub that may house a CPU and/or other various control boards.

C.4. FIG. 4

FIG. 4 discloses a plug 100, according to one example embodiment, with only a downhole GR 105 and an expansion ring 202, under compression and in the sealing position. The plug 100 of FIG. 4 may be used during low pressure fracs, that is, fracs that do not exceed 8,000 PSI differential pressure above/below the plug 100. Low pressure fracs may not require the use of an uphole GR 105.

C.4.1 Expansion Ring Expanded

Under compression, and in the sealing position, the expansion ring 202 may flex and conform to the elastomer element 103 and act as a barrier, or protection device during a frac, or other downhole process. When compressed, the expansion ring 202 may expand to the casing wall.

C.4.2 Compressed Elastomer Element

The elastomer element 103 is expanded in its sealed/compressed state. In the example of FIG. 4, the elastomer element 103 is the first seal downhole.

C.4.3 Receptacle Guide Pin Locked in Receptacle Guide

The receptacle guide pin 312 is locked in place at the end of the receptacle guide 204. This configuration and arrangement prevents the plug 100 from rotating and continuing to compress the elastomer element 103.

C.4.4 Guardian Ring Engaged with Receptacle and Elastomer Element

At full stroke, or when reaching full stroke, the GR 105 may engage with a configured surface (see FIGS. 5*a* and 5*b*) of the receptacle 104 that may act as a guardian ring keeper. Also at full stroke, or when reaching full stroke, the GR 105 is also engaging with the compressed elastomer element 103 and the elastomer element 103 from extruding past the receptacle 104. With reference to the aforementioned 'full stroke,' when the piston 404 has been hydraulically actuated in the barrel 107, full stroke will be in the range of bottoming out the piston 404 in the barrel 107 which, in turn, ensures that the GR 105 will engage the casing wall ID before the piston 404 reaches full stroke.

C.4.5 Hydraulic Pressure

Segment 402 is a section of the barrel 107 that may be hydraulicly pressured up to compress the elastomer element 103, or activate the plug 100 to seal.

C.4.6 Piston (Bottomed Out)

During this operation, a piston 404 of the plug 100 may bottom out on the bottom end of the barrel 107, or hydraulic pump interface end. The bottoming out of the piston 404 may reduce the chances of back pressure build up on a hydraulic pump (not shown) which may be connected to the pump interface 316. Back pressure on the hydraulic pump may in turn cause the hydraulic pump to activate its pressure relief valve. Bottoming out the piston 404 may also reduce, or eliminate, the possibility of the elastomer element 103 over extruding while under pressure.

Figure 5B:
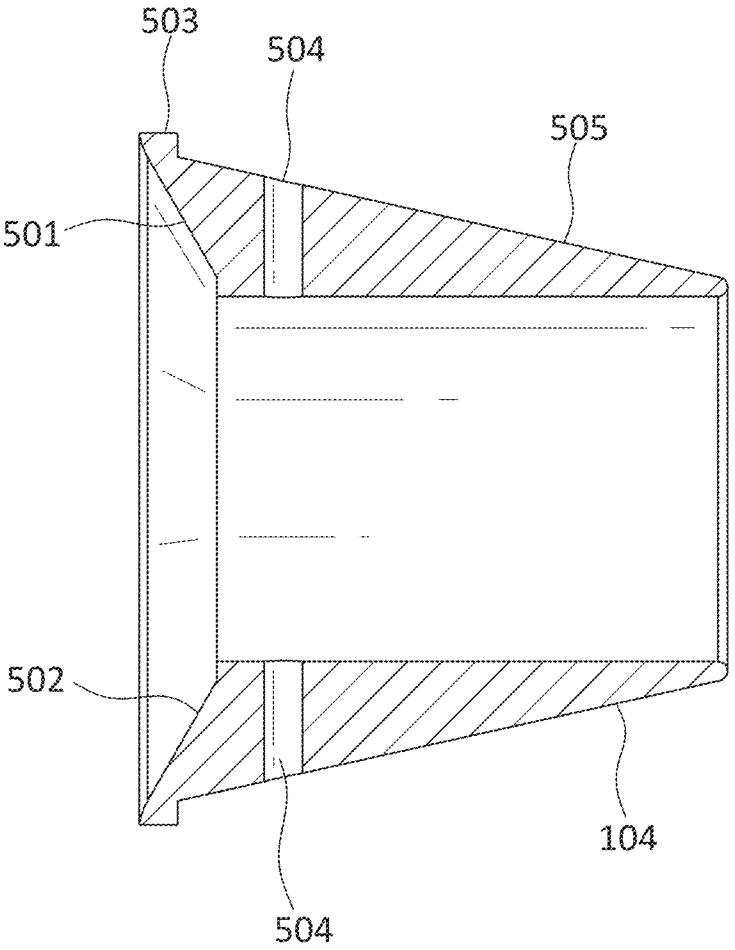
FIGS. 5*a* and 5*b* are isometric and cross section side views, respectively, of a receptacle.
Figure 5A:
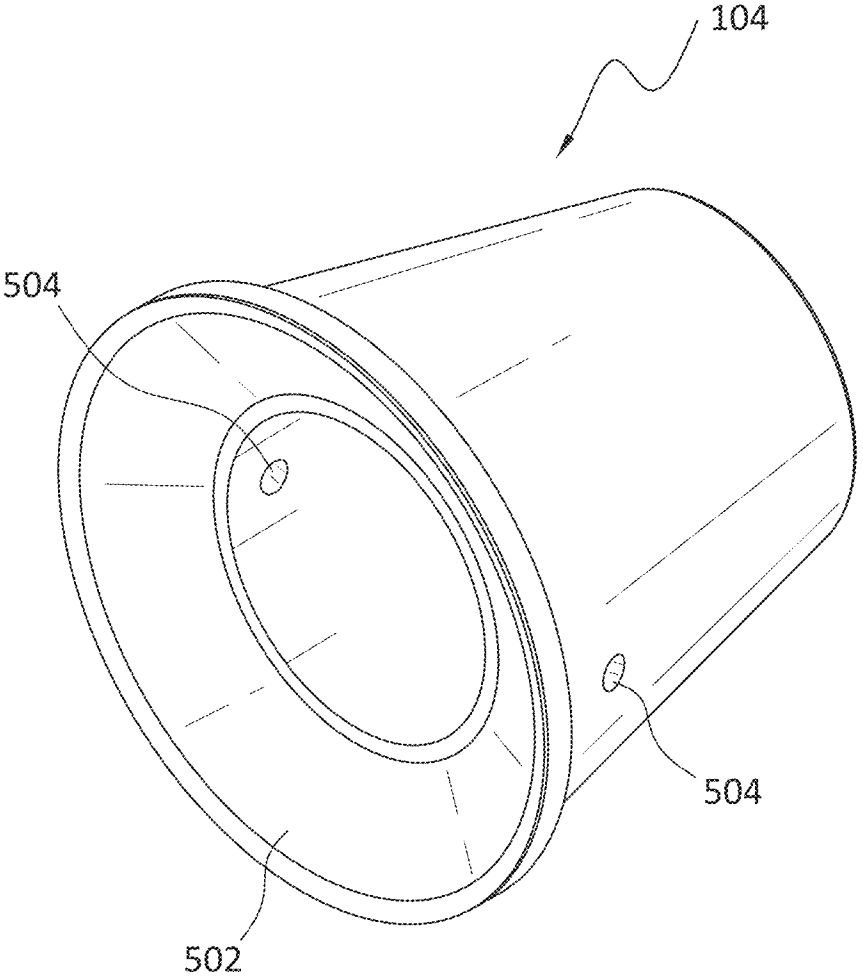

C.5 FIGS. 5*a* and 5*b*

FIGS. 5*a* and 5*b* respectively comprise an isometric view and a cross section view of an example embodiment of a receptacle 104.

C.5.1 Element Enclosure

The elastomer element enclosure 501 surface may act as a guide, as well as added protection, for the elastomer element 103. The enclosure 501 may comprise a sealing surface 502 with a chamfer angled in a range of about 25-75 degrees relative to a longitudinal axis of the receptacle 104. This chamfer may be configured such that it forces the elastomer element 103 into a more optimal sealing position, focusing the forces and moving the sealing surface 502 to a position where it is concentric with the elastomer element 103.

C.5.2 Retainer

A retainer 503 may comprise an annular edge, lip, or other configuration, that may ensure that the GR 105 does not slide off the end of the receptacle 104 while engaged, or during the engaging process between the GR 105 and the receptacle 104.

C.5.3 RGP Slot

The RGP slot 504 receives the receptacle guide pin 312 (not shown in FIGS. 5*a* and 5*b*). There may be one or more receptacle guide pins 312 per RGP slot 504.

C.5.4 GR Guide Surface

The GR guide surface 505 is configured to allow the GR to move axially back and forth along the receptacle 104 without restriction. The GR guide surface 105, which may be angled relative to a longitudinal axis of the GR 105, guides the GR 105 up to the retainer 503 and the compressed elastomer element 103.

Figure 6B:
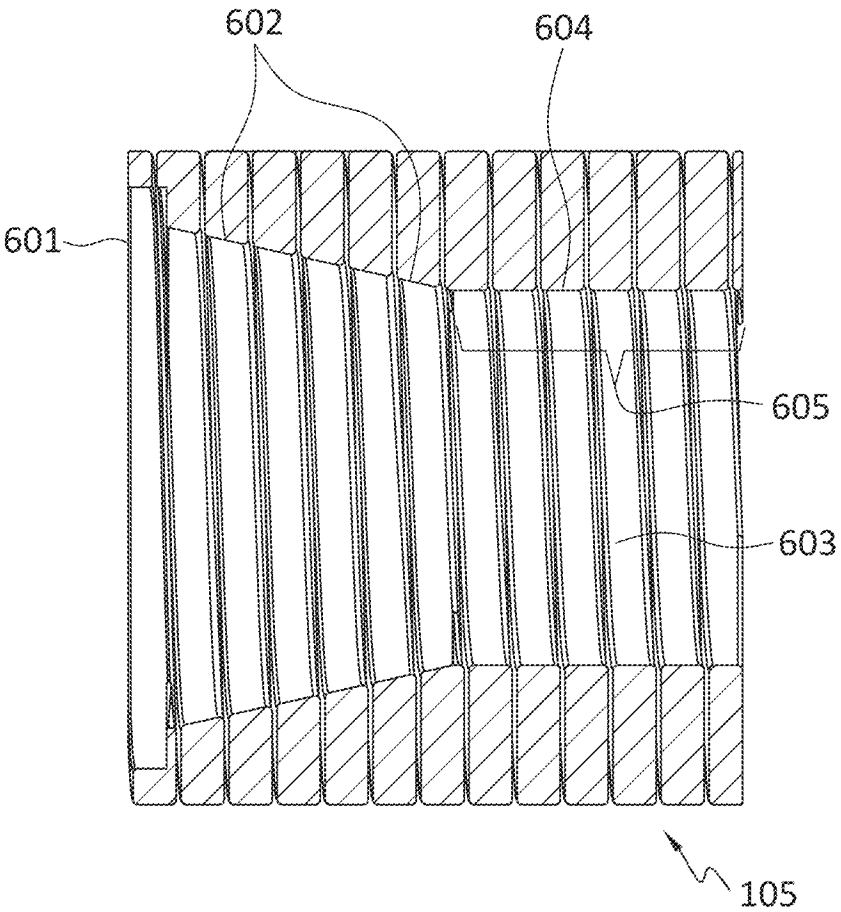
FIGS. 6*a* and 6*b* are isometric and cross section views, respectively, of a guardian ring in an un-expanded state.
Figure 6A:
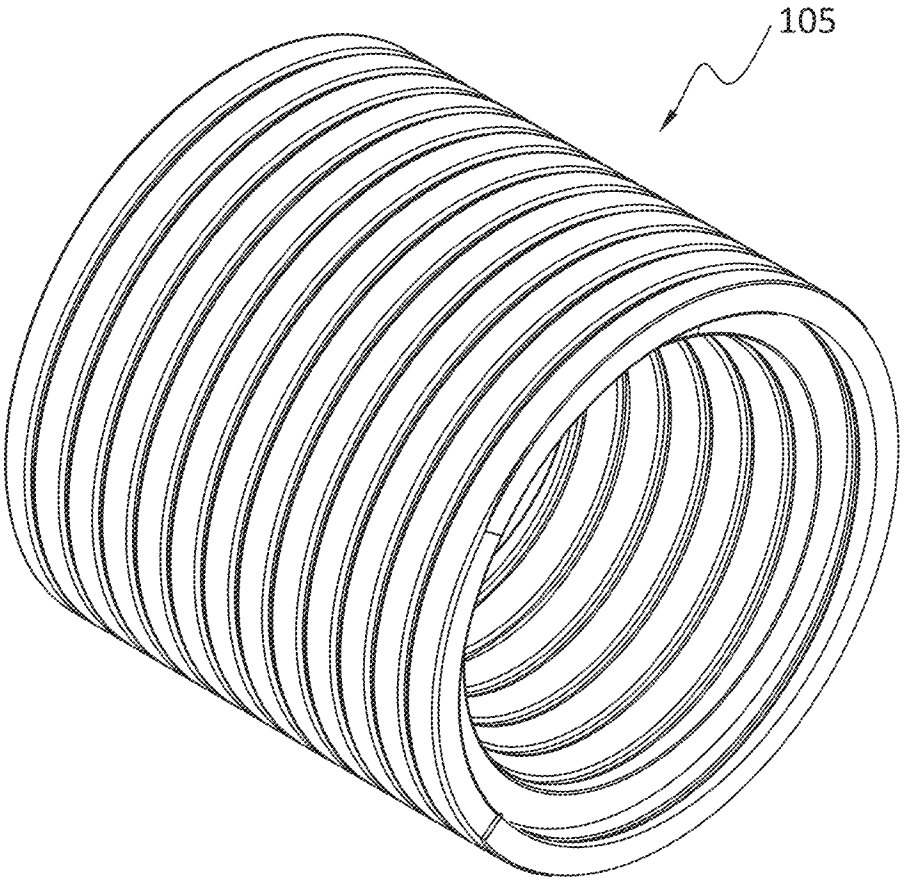

C.6 FIGS. 6*a* and 6*b*

FIGS. 6*a* and 6*b* disclose an example embodiment of a guardian ring 105 in an unexpanded state.

C.6.1 Landing

The landing 601 may comprise a surface that interfaces with the retainer 503 that is located on the receptacle 104. The landing 601 may be configured to withstand the forces and loads that the GR 105 may be subjected to when the plug 100 is in compression.

C.6.2 Guide Expansion Area

The guide expansion area 602 of the GR 105 may be angled, relative to a longitudinal axis of the GR 105, to match the angle of the GR guide surface 505 of the receptacle. The guide expansion area 602 may be the portion of the GR 105 that expands first while under compression. As the receptacle 104 is forced through the center opening 603 defined by the GR 105, the guide expansion area 602 may begin to expand outward.

C.6.3 Secondary Expansion Area

A secondary expansion area 604 may be configured to define a flat surface 605 that mates with the rod 101. This secondary expansion area 604 may also be guided up the receptacle 104 when the plug 100 is in compression and may act as a load bearing section of the GR 105.

Figure 7B:
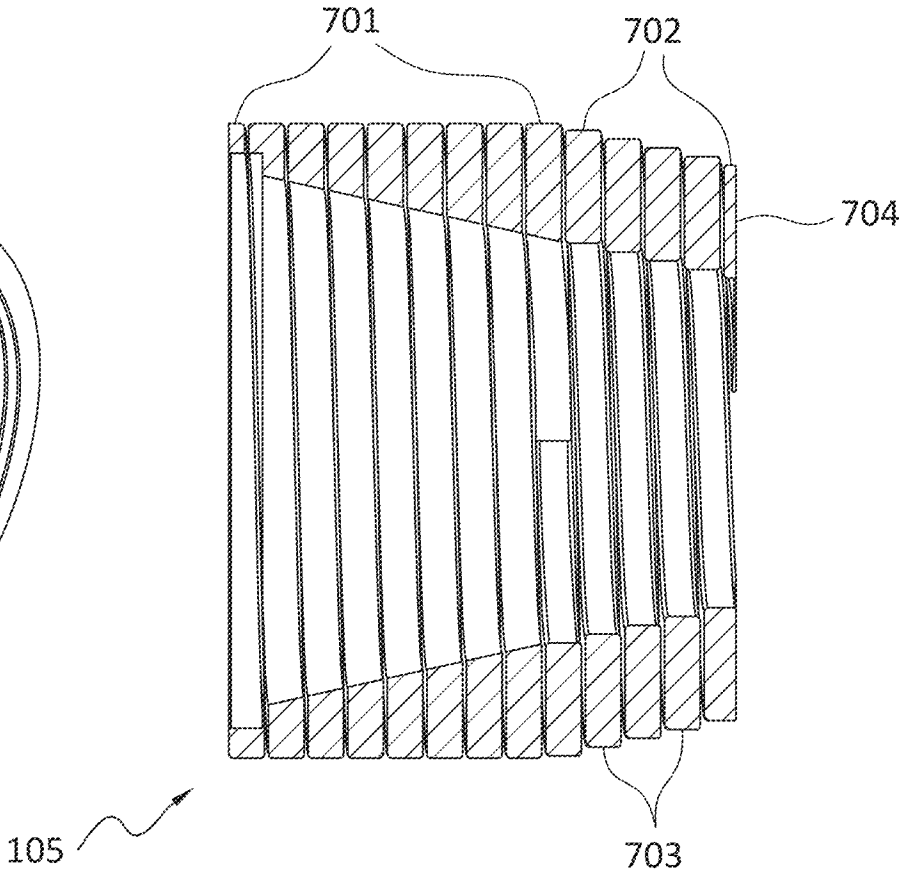
FIGS. 7*a* and 7*b* are isometric and cross section views, respectively, of a guardian ring in an expanded state.
Figure 7A:
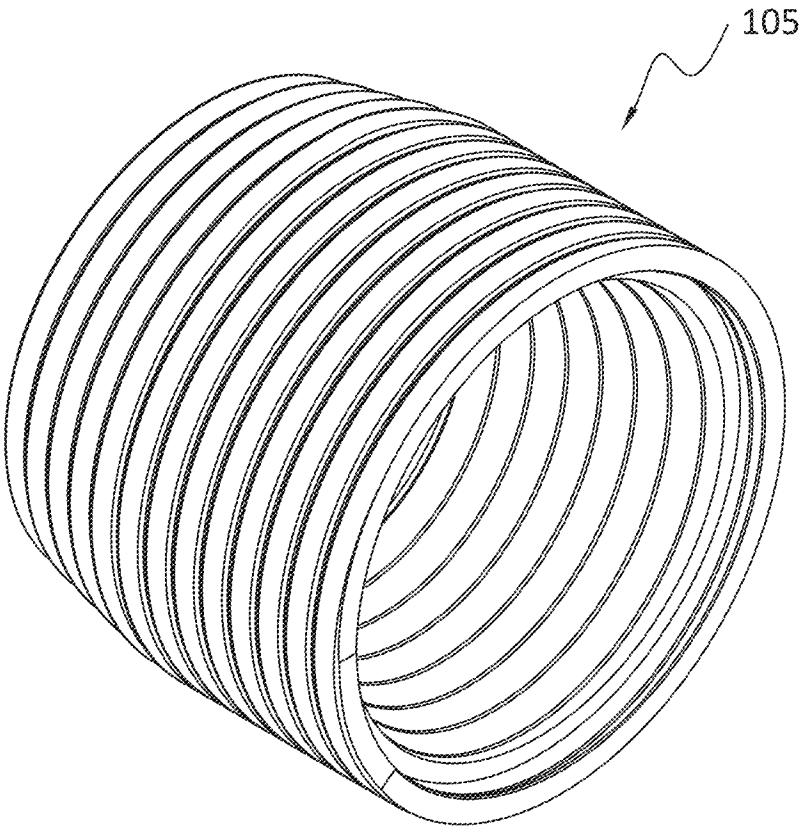

C.7 FIGS. 7*a* and 7*b*

FIGS. 7*a* and 7*b* show an embodiment of a GR 105 in an expanded state.

C.7.1 Extrusion Prevention and Slip Area

An extrusion prevention and slip area 701 of the GR 105 may be configured to be engaged with the casing and act as an extrusion prevention mechanism for the elastomer element 103 while the elastomer element 103 is in compression, or under load. The extrusion prevention functionality is realized by conformance of the GR 105 to the inside diameter (ID) of the casing and taking up the gap that the elastomer element 103 may otherwise extrude past, or through. This extrusion prevention and slip area 701 may also act as an anti-slip area for the plug 100. When engaged with the casing wall, the GR 105 may take load off the plug 100 and lock the plug 100 into a particular downhole location in the casing, or pipe, wall.

C.7.2 Secondary Extrusion Prevention and Slip Area

A secondary extrusion prevention and slip area 702 may also act as an anti-slip area as well as a load bearing area for the plug 100 when the plug 100 is under load or mechanical forces. As an embodiment of the GR 105 may take the form of a helical spring comprising multiple rings 703, the load may be transferred from ring 703 to ring 703 when the plug 100 is under compression, or load.

C.7.3 Load Bearing Area

The load bearing area 704 is the surface of the GR 105 that may be interfacing with components such as the cap 106. The load bearing area 704 may be the final area that may take and or transfer a load that is imposed on the GR 105.

C.8 FIG. 8

Figure 8:
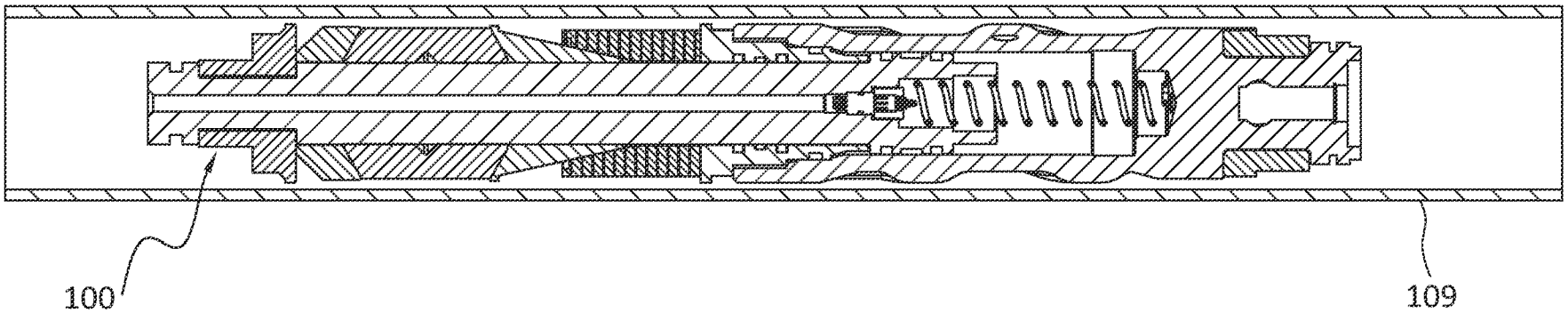
FIG. 8 is a cross section side view of a plug in a casing.

FIG. 8 shows an example embodiment of a plug 100 in a cased hole, or pipe 109. The plug 100 is in its uncompressed, or undeformed state. The example plug 100 illustrated in FIG. 8 may be tethered to wireline, connected to pipe and or coiled tubing, or may be conveyed by a tractor or propulsion system that may operate downhole or in a pipe.

C.9 FIG. 9

Figure 9:
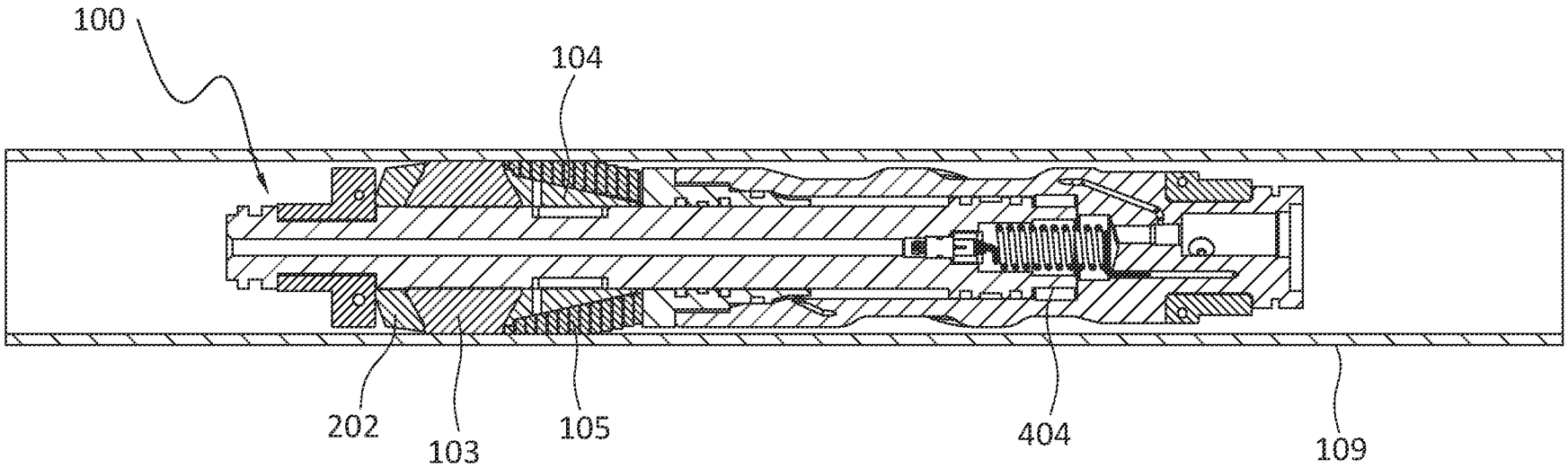
FIG. 9 is a cross section side view of a plug compressed in a casing.

FIG. 9 shows the same example plug 100, as illustrated in FIG. 8, but under compression, or energized. In FIG. 9, the plug is sealing the cased hole, or pipe. The GR 105 is engaged with the pipe wall, the elastomer element 103 is compressed and engaged with the pipe wall, and the piston 404 is bottomed out. As well, the receptacle 104 has reached the end of its stroke. In this state, the plug 100 may be configured to take differential pressures greater than 10,000 PSI, when energized, that is, when fully compressed.

C.10 FIG. 10

FIG. 10 shows an example embodiment of a plug 1000 comprising two GRs 105 and two receptacles 104. In respects other than the foregoing, the plug 1000 may be identical to the plug 100. The plug 1000 is shown in its uncompressed, or unenergized, state. The first GR 105 and receptacle 104 is the uphole set, and the other GR 105 and receptacle 104 is the downhole set. The uphole set may be configured as an anti-slip, load bearing, and sealing system, creating a metal-to-metal seal in front of the elastomer element 103, or uphole of the elastomer element 103 when the plug 1000 is under compression.

C.11 FIG. 11

FIG. 11 shows the example plug 1000 as illustrated in FIG. 10, under compression. In this example, the two GRs 105 completely protect the elastomer element 103 from extrusion, as well as from differential loading. The uphole GR 105 may take the mechanical loads created uphole when the plug 1000 is in compression. Mechanical loads may be exerted on the plug 1000 during a stimulation process.

C.12 FIG. 12

The embodiments disclosed herein may include the use of a special purpose or general-purpose computer including various computer hardware or software modules, as discussed in greater detail below. A computer may include a processor and computer storage media carrying instructions that, when executed by the processor and/or caused to be executed by the processor, perform any one or more of the methods disclosed herein, or any part(s) of any method disclosed.

As indicated above, embodiments within the scope of the present invention also include computer storage media, which are physical media for carrying or having computer-executable instructions or data structures stored thereon. Such computer storage media may be any available physical media that may be accessed by a general purpose or special purpose computer.

By way of example, and not limitation, such computer storage media may comprise hardware storage such as solid state disk/device (SSD), RAM, ROM, EEPROM, CD-ROM, flash memory, phase-change memory ("PCM"), or other optical disk storage, magnetic disk storage or other magnetic storage devices, or any other hardware storage devices which may be used to store program code in the form of computer-executable instructions or data structures, which may be accessed and executed by a general-purpose or special-purpose computer system to implement the disclosed functionality of the invention. Combinations of the above should also be included within the scope of computer storage media. Such media are also examples of non-transitory storage media, and non-transitory storage media also embraces cloud-based storage systems and structures, although the scope of the invention is not limited to these examples of non-transitory storage media.

Computer-executable instructions comprise, for example, instructions and data which, when executed, cause a general-purpose computer, special purpose computer, or special purpose processing device to perform a certain function or group of functions. As such, some embodiments of the invention may be downloadable to one or more systems or devices, for example, from a website, mesh topology, or other source. As well, the scope of the invention embraces any hardware system or device that comprises an instance of an application that comprises the disclosed executable instructions.

Although the subject matter has been described in language specific to structural features and/or methodological acts, it is to be understood that the subject matter defined in the appended claims is not necessarily limited to the specific features or acts described above. Rather, the specific features and acts disclosed herein are disclosed as example forms of implementing the claims.

As used herein, the term 'module' or 'component' may refer to software objects or routines that are executed on the computing system. The different components, modules, engines, and services described herein may be implemented as objects or processes that execute on the computing system, for example, as separate threads. While the system and methods described herein may be implemented in software, implementations in hardware or a combination of software and hardware are also possible and contemplated. In the present disclosure, a 'computing entity' may be any computing system as previously defined herein, or any module or combination of modules running on a computing system.

In at least some instances, a hardware processor is provided that is operable to carry out executable instructions for performing a method or process, such as the methods and processes disclosed herein. The hardware processor may or may not comprise an element of other hardware, such as the computing devices and systems disclosed herein.

In terms of computing environments, embodiments of the invention may be performed in client-server environments, whether network or local environments, or in any other suitable environment. Suitable operating environments for at least some embodiments of the invention include cloud computing environments where one or more of a client, server, or other machine may reside and operate in a cloud environment.

Figure 12:
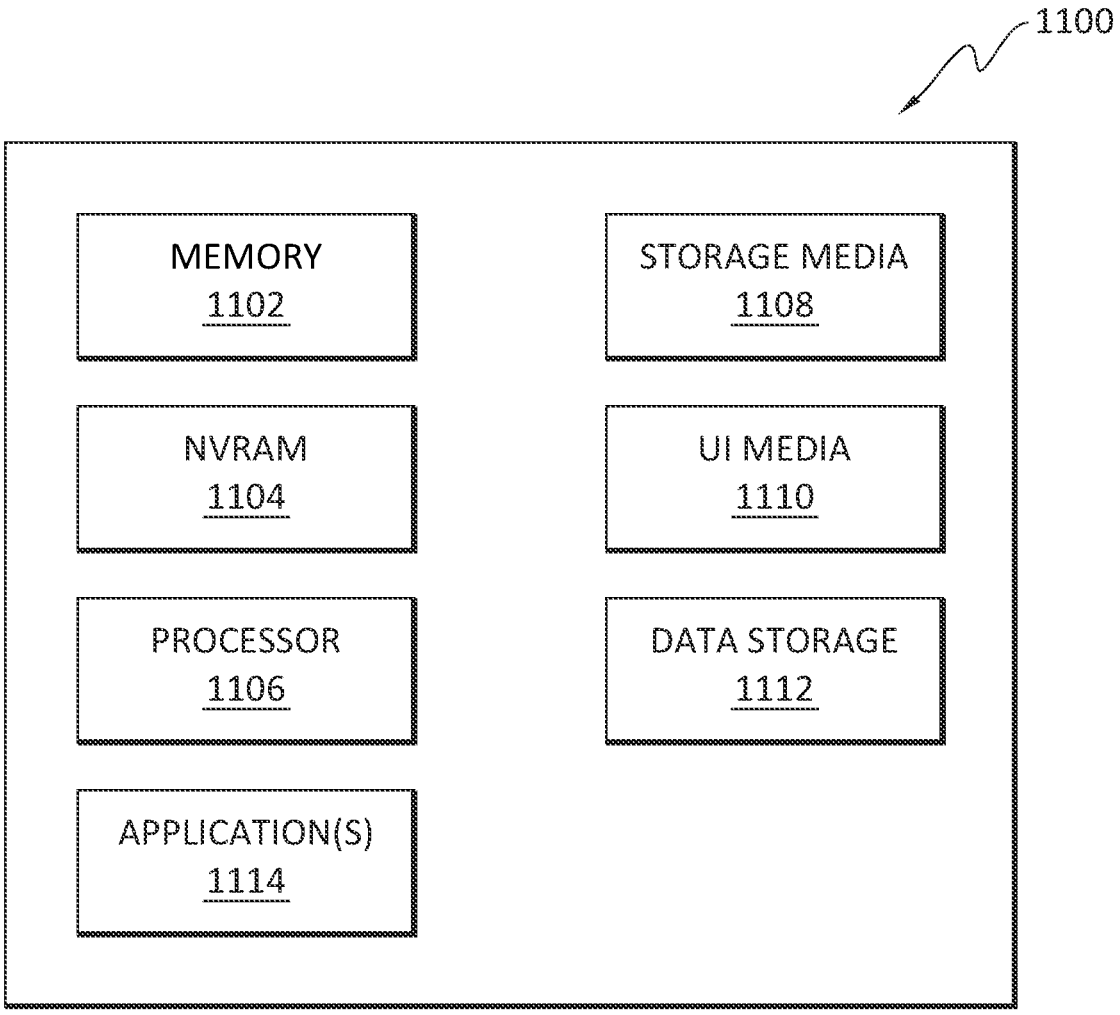
FIG. 12 is an example computing entity configured to perform any of the disclosed computer implemented methods, processes, and operations.

With reference briefly now to FIG. 12, any one or more of the entities disclosed, or implied, by FIGS. 1-11 and/or elsewhere herein, may take the form of, or include, or be implemented on, or hosted by, a physical computing device, one example of which is denoted at 1100. As well, where any of the aforementioned elements comprise or consist of a virtual machine (VM), that VM may constitute a virtualization of any combination of the physical components disclosed in FIG. 12.

In the example of FIG. 12, the physical computing device 1100 includes a memory 1102 which may include one, some, or all, of random-access memory (RAM), non-volatile memory (NVM) 1104 such as NVRAM for example, read-only memory (ROM), and persistent memory, one or more hardware processors 1106, non-transitory storage media 1108, UI (user interface) device 1110, and data storage 1112. One or more of the memory components 1102 of the physical computing device 1100 may take the form of solid-state device (SSD) storage. As well, one or more applications 1114 may be provided that comprise instructions executable by one or more hardware processors 1106 to perform any of the operations, or portions thereof, disclosed herein.

Such executable instructions may take various forms including, for example, instructions executable to perform any method or portion thereof disclosed herein, and/or executable by/at any of a storage site, whether on-premises at an enterprise, or a cloud computing site, client, datacenter, data protection site including a cloud storage site, or backup server, to perform any of the functions disclosed herein. As well, such instructions may be executable to perform, or cause the performance of, any of the other operations and methods, and any portions thereof, disclosed herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

a rod;

an uphole coupling through which the rod extends;

an expansion ring positioned on the rod below the uphole coupling;

an elastomer element positioned on the rod below, and in contact with, the expansion ring;

a metal receptacle positioned on the rod below the elastomer element and configured to receive a portion of the elastomer element;

a guardian ring positioned on the rod below the receptacle, and a portion of the receptacle is received in the guardian ring;

a cap positioned on the rod and in contact with the guardian ring; and a barrel to which the cap is connected, wherein the rod is partially received in the barrel, and one of the barrel and the rod is movable with respect to the other of the barrel and the rod to exert a compression load on the elastomer element.

2. The apparatus as recited in claim 1, wherein the guardian ring has a helical configuration that is configured to assume a compressed state, and a relaxed state.

3. The apparatus as recited in claim 1, wherein the elastomer element is configured to assume a compressed state in which the elastomer element is elastically deformed, and when the elastomer element is in the compressed state, an outside diameter of the elastomer element is greater than an outside diameter of the elastomer element when the elastomer element is in a relaxed state.

4. The apparatus as recited in claim 1, wherein when the apparatus is in a compressed state within a wellbore, the guardian ring and the elastomer element are in annular contact with an interior diameter of the wellbore.

5. The apparatus as recited in claim 1, wherein the guardian ring is configured to expand under compression and prevent extrusion of the elastomer element when the apparatus is positioned in a downhole location.

6. The apparatus as recited in claim 1, wherein the apparatus comprises a frac plug.

7. The apparatus as recited in claim 1, wherein when the guardian ring is positioned in a wellbore, and then compressed, the guardian ring prevents slippage of the apparatus along the wellbore.

8. The apparatus as recited in claim 1, wherein the guardian ring is positioned downhole of the elastomer element when the apparatus is in a downhole location, and the apparatus further comprises another guardian ring that is positioned uphole of the elastomer element when the apparatus is in the downhole location.

9. The apparatus as recited in claim 1, wherein the guardian ring prevents imposition of a differential pressure across the elastomer element when a frac process is being performed using the apparatus in a compressed state.

10. The apparatus as recited in claim 1, wherein the apparatus comprises an electrical conductor passing through the rod.

11. The apparatus as recited in claim 1, wherein the expansion ring is elastically deformable and is configured to change shape under compression.

12. The apparatus as recited in claim 1, wherein the receptacle comprises a retainer that limits axial travel of the guardian ring relative to the receptacle when the apparatus is compressed.

13. A method, comprising:

deploying a frac plug to a downhole location in a wellbore; and using the frac plug to seal a portion of the wellbore by performing operations comprising:

exerting pressure on a portion of the frac plug;

compressing, in response to exertion of the pressure, an elastomer element of the frac plug by, and between, an expansion ring of the frac plug and a metal receptacle of the frac plug, wherein compression of the elastomer element by, and between, the expansion ring and the metal receptacle causes an outside diameter of the elastomer element to increase relative to a size of the outside diameter of the elastomer element prior to the compression; and exerting, by the compressed elastomer element, a pressure on a casing disposed in the wellbore, until that pressure reaches a sealing pressure sufficient to seal the portion of the wellbore to prevent flow of fluids and/or solids past the frac plug.

14. The method as recited in claim 13, wherein a guardian ring, in contact with the metal receptacle, when compressed, exerts an axial load on the metal receptacle.

15. The method as recited in claim 13, wherein an expansion ring positioned between the elastomer element and an uphole coupling of the frac plug prevents extrusion of the elastomer element when the pressure is exerted on the frac plug.

16. The method as recited in claim 13, wherein a guardian ring, in contact with the metal receptacle, prevents extrusion of the elastomer element past the guardian ring when the pressure is exerted on the frac plug.

17. The method as recited in claim 13, wherein the pressure is exerted on the frac plug by introducing hydraulic fluid into a fluid passageway of a barrel configured and arranged to act on a guardian ring that contacts the metal receptacle.

18. The method as recited in claim 13, wherein the method is performed as part of a frac'ing process at one or more stages of the wellbore.

19. The method as recited in claim 13, wherein when a first guardian ring in contact with the metal receptacle, and another guardian ring, are both expanded in response to exertion of the pressure, the first guardian ring and the another guardian ring prevent imposition of a differential pressure across the elastomer element.

20. The method as recited in claim 13, wherein after the wellbore is sealed, the frac plug is reused to seal another portion of the wellbore.

* * * * *